United States Patent [19]

Baus

[11] 4,350,646

[45] Sep. 21, 1982

[54] EVAPORATION AIR-HUMIDIFIER

[76] Inventor: Heinz G. Baus, Wartbodenstrasse 35, CH-3626 Hünibach-Thun, Fed. Rep. of Germany

[21] Appl. No.: 265,654

[22] Filed: May 20, 1981

[30] Foreign Application Priority Data

May 24, 1980 [DE] Fed. Rep. of Germany ..... 3020031

[51] Int. Cl.[3] ..... B01F 3/04

[52] U.S. Cl. ..... 261/29; 261/36 R; 261/106; 261/DIG. 3; 312/31.1; 417/360; 417/420

[58] Field of Search ..... 261/24, 29, 36 R, 91, 261/92, 106, DIG. 3, DIG. 4, DIG. 15; 312/23, 31.01, 31.03, 31.06, 31.1, 31.2; 417/360, 420

[56] References Cited

U.S. PATENT DOCUMENTS

| | | | |
|---|---|---|---|
| 1,894,864 | 1/1933 | Hall | 261/91 |
| 2,827,270 | 3/1958 | Martin | 261/29 |
| 2,874,797 | 2/1959 | Flury | 261/29 X |
| 3,193,261 | 7/1965 | Nesbitt | 261/29 X |
| 3,348,821 | 10/1967 | Martin et al. | 261/29 |
| 3,376,025 | 4/1968 | Flury | 261/29 |
| 3,528,781 | 9/1970 | Gelfman et al. | 261/29 X |
| 3,914,349 | 10/1975 | Stipanuk | 261/29 |

FOREIGN PATENT DOCUMENTS

| | | | |
|---|---|---|---|
| 7506266 | 7/1975 | Fed. Rep. of Germany | 261/29 |

*Primary Examiner*—Richard L. Chiesa

*Attorney, Agent, or Firm*—Herbert L. Lerner; Laurence A. Greenberg

[57] ABSTRACT

Evaporation air-humidifier having a water storage container with a support plate carrying an evaporation filter and a pump extending into the water storage container, a fan, a motor for driving the pump, a hood formed with air inlet and air outlet openings, the motor being fastened to the hood, and a clutch between the motor and the pump, the clutch being automatically engageable when the hood is disposed on the storage container and automatically disengageable when the hood is removed from the storage container, including a substantially hollow cylindrical flow channel wherein the motor and the fan are disposed, the flow channel extending from the underside of the hood at least to the fan.

4 Claims, 2 Drawing Figures

EVAPORATION AIR-HUMIDIFIER

Figure 1:
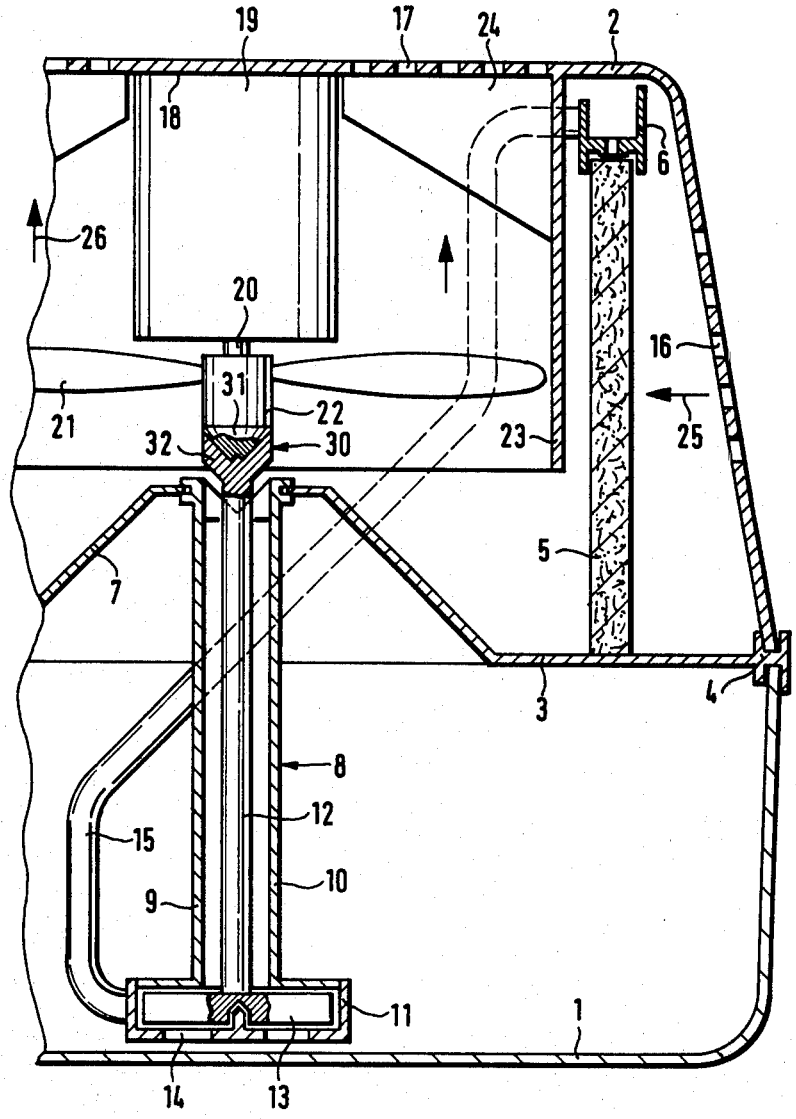

The invention relates to an evaporation air-humidifier with a water storage container, a support plate which carries an evaporation filter and a pump extending into the water storage container, a fan, a motor for driving the pump, and a hood having air inlet and outlet openings, the motor being fastened to the hood and a clutch between the motor and the pump, by means of which, when, respectively, raising and putting-on the hood, the clutch is automatically disengageable and engageable, respectively.

In German Petty Patent (DE-GM) No. 75 06 266, an evaporation air-humidifier is described wherein a motor as well as a fan are disposed on a cover or on a hood, respectively. Into the water supply container of the evaporation air-humidifier of the German petty patent, there extends a pump having a drive shaft which is connectible with and releasable from, respectively, the shaft of the aforementioned motor by means of a plug-in coupling. The fan is located on the upper end of the evaporation humidifier, whereat a liquid distributor channel is also disposed to which water from the water supply container is fed by means of the pump through a hose or the like. This heretofore known evaporation air-humidifier has a relatively great overall height because the fan is located in the region of the upper end of evaporation filter. Furthermore, because the motor is located between the underside and the fan, a corresponding increase in the overall height of the evaporation air-humidifier is required.

An evaporation air-humidifier constructed in this manner is thus bulky and cumbersome, and comparatively great construction and finishing expense is required for the evaporation air-humidifier and especially the hood thereof to have the necessary strength and rigidity. It is readily apparent that a relatively great total weight is also thereby required.

It is accordingly an object of the invention to provide an evaporation air-humidifier of the aforementioned general type which, for a comparatively modest construction and manufacturing expense, a low overall height i.e. a small spacing between the bottom of the water supply container and the hood or the upper edge thereof, respectively, is attained.

It is also an object of the invention to provide such an evaporation air-humidifier which will ensure an orderly or regular air guidance of the air sucked in through the air inlet openings via the evaporator filters and blown out by means of the fan through the air outlet openings.

With the foregoing and other objects of the invention, there is provided an evaporation air-humidifier having a water storage container with a support plate carrying an evaporation filter and a pump extending into the water storage container, a fan, a motor for driving the pump, a hood formed with air inlet and air outlet openings, the motor being fastened to the hood, and a clutch between the motor and the pump, the clutch being automatically engageable when the hood is disposed on the storage container and automatically disengageable when the hood is removed from the storage container, comprising a substantially hollow cylindrical flow channel wherein the motor and the fan are disposed, the flow channel extending from the underside of the hood at least to the fan.

The evaporation air-humidifier according to the invention is marked primarily by a relatively simple construction, whereby a low overall height is attained in a relatively simple manner. By means of the flow channel, an orderly course of flow of the air drawn through the air inlet openings by the fan and the air blown out through the air outlet openings is ensured. The overall structural height of the evaporation air-humidifier is prescribed, on the one hand, by the height of the water supply container and therewith by the water storage volume and, on the other hand, by the required height of the evaporation filter. The size of the motor, the fan, the clutch as well as the pump shaft, on the other hand, have practically no effect upon the overall structural height of the evaporation air-humidifier.

The last-mentioned components can consequently be designed and prescribed in accordance with respective requirements without having to enter thereby into any compromises in order to maintain a low overall height.

In accordance with another feature of the invention, stiffening ribs are located at the underside of the hood and within the flow channel. By means of these stiffening ribs, on the one hand, the stability and strength of the flow channel is increased and, on the other hand, the air flow is suitably affected or controlled so that flow noises or fan noises are considerably diminished or eliminated.

In accordance with a further feature of the invention, the flow channel is surrounded by the evaporation filter or the flow channel extends into the evaporator filter, respectively, the liquid distributor channel disposed on the evaporator filter being located substantially directly beneath the underside of the hood. Thus, the flow channel dimensions can be coordinated with or adjusted to the dimensions of the fan without difficulty, while the evaporation filter as well as the liquid distributor channel for its part can be constructed in accordance with the required liquid throughput or flow-through rate. Because the liquid distributor channel is disposed directly beneath the underside of the hood, a low overall structural height of the evaporation air-humidifier is also thus ensured.

In accordance with an added feature of the invention, the fan is located substantially at half the height between the support plate and the underside of the hood. In other words, the fan is disposed somewhat in a region located at half the height of the evaporation filter, and air sucked in through the air inlet openings will therefore flow largely uniformly through the evaporation filter.

In accordance with an additional feature of the invention, the flow channel extends from the underside of the hood to a location below the fan. Consequently, in an especially simple manner, assurance is provided also that, in vicinity of the underedge of the flow channel, no undue turbulence or flows occur which would have a disadvantageous effect upon the efficiency of the evaporation air-humidifier.

The fan is thus preferably mounted at the lower end of the motor shaft. The fan is thereby located between the motor and the pump, at a relatively great distance from the air outlet openings of the hood, so that externally detectable noise is relatively low. Also, the air moved by the fan brushes past the motor and effects cooling thereof.

It is also noted that the motor has only one shaft end extending from the housing thereof, at which end both the fan and a first clutch half are arranged. A motor of this type is more econimical than a motor with two externally extending shaft endings.

The clutch provided between the motor and the pump, is an independently controlled clutch because, in accordance with the invention, the connection of the motor and pump shafts is broken or established by the lifting-off or replacement of the hood. In accordance with other features of the invention, the clutch is force-locking, especially by magnetic forces, or form-locking, especially by toothing.

In a prefered embodiment of the invention, the clutch is constructed as a magnetic clutch, a permanent magnet preferably mounted on the pump shaft. The first clutch half of the motor is formed of soft iron, so that a magnetic force is applied in direction of the substantially vertical shafts of the motor and the pump, respectively. Since the motor is firmly connected to the hood, by suitably dimensioning the magnetic clutch and the magnetic holding force, respectively, it is possible to have the pump shaft completely carried by the motor shaft, and a special axial support or bearing for the pump shaft is not required.

In accordance with an additional feature of the invention, the clutch can be constructed as a plug-in clutch having clutch halves which automatically disengage and mesh, respectively, when the hood is lifted-off or replaced. More specifically in accordance with the invention the first and second clutch halves are provided with intermeshable teeth, to assure a reliable drive of the pump.

In accordance with yet another feature of the invention, the associated clutch halves are of conical shape, having respective conical matching surfaces to assure a good central alignment of the motor and the pump when the hood is placed in position or when the connection between the motor and the pump is established, respectively.

In accordance with an additional feature of the invention, the motor and the fan are disposed in a hollow cylindrical flow channel, which is also located at the underside of the hood. It is especially important, in accordance with the invention, that the flow channel extend from the underside of the bonnet closely to the vicinity of the fan, so that a trouble-free flow of the sucked-in air saturated with moisture through the evaporation filter to the air outlets is effected. In accordance with the invention, stiffening ribs are provided which also serve to guide the air stream.

In accordance with a concomitant feature of the invention, the pump has a housing surrounding the pump shaft and formed with radially inwardly directed projections. The pump shaft is braceable on these projections when the hood is removed and, when the hood is repositioned, the required connection is readily reestablished.

Other features which are considered as characteristic for the invention are set forth in the appended claims.

Although the invention is illustrated and described herein as embodied in an evaporation air-humidifier, it is nevertheless not intended to be limited to the details shown, since various modifications and structural changes may be made therein without departing from the spirit of the invention and within the scope and range of equivalents of the claims.

Figure 2:
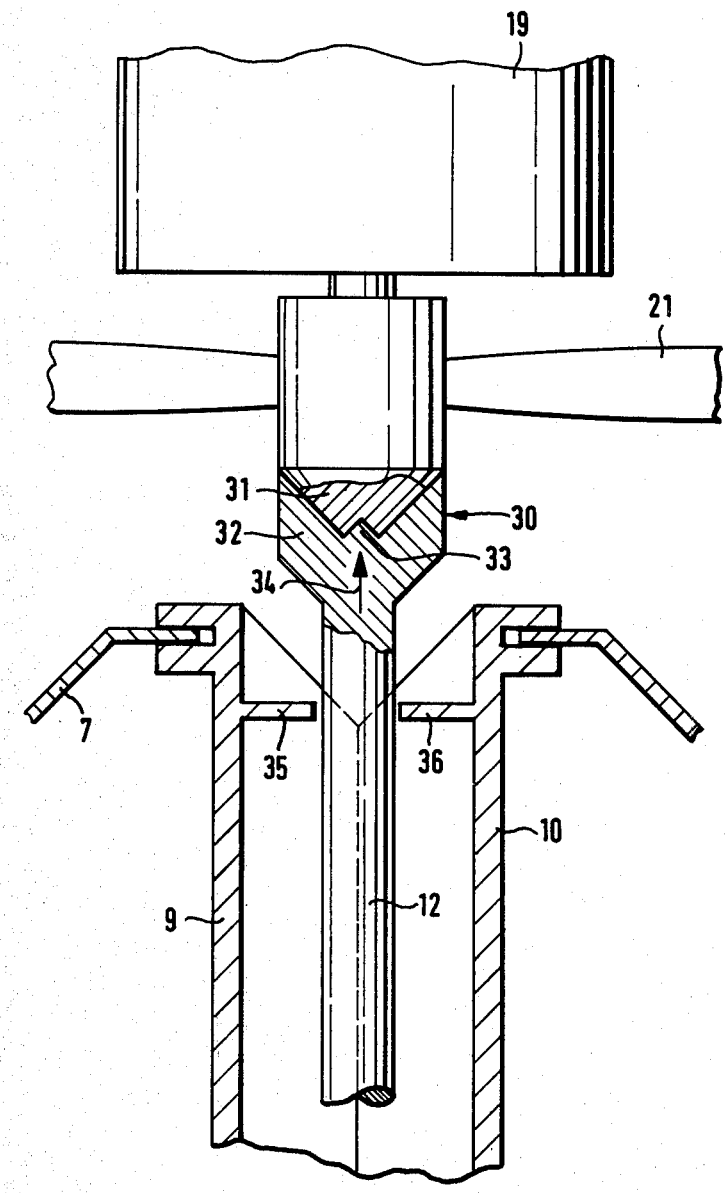

The construction and method of operation of the invention, however, together with additional objects and advantages thereof will be best understood from the following description of specific embodiments when read in connection with the accompanying drawings, in which:

FIG. 1 is a fragmentary cross-sectional view of an evaporation air-humidifier constructed in accordance with the invention; and FIG. 2 is an enlarged fragmentary view of FIG. 1 showing a clutch and a fan forming parts thereof.

Referring now to the drawing and first, particularly, to FIG. 1 thereof, there is shown an evaporation air-humidifier according to the invention having a box-shaped housing. This housing is made up of a lower part in the form of a water storage container 1 and a hood or dome 2, with a support plate 3 disposed therebetween. The support plate 3 has a surrounding rim 4 with an H-shaped cross section with which it lies on the water storage container 1. The hood 2 also engages in the H-shaped rim 4, so that a closure impervious to the outside is provided. An evaporation filter 5 is disposed on the support plate 3, and a liquid distributor trough 6 is located on top of the filter 5. The support plate 3 has an upwardly directed mounting projection 7 in which a pump 8 is suspended.

The pump 8 has a housing with two support-tube halves 9 and 10 and a lower, pot-shaped housing part 11. Furthermore, the pump includes a shaft 12 with an otherwise non-illustrated pump impeller 13. The housing part 11 is provided with openings 14, through which water is sucked-in from the water storage container 1 and pumped by the pump impeller 13 through a tube 15 into the distribution trough 6.

The hood 2 has air inlet openings 16 at the side thereof and air outlet openings 17 above. A diagrammatically indicated electric motor 19 is disposed at the underside 18 of the hood 2. The shaft of the motor 19, like the shaft 12 of the pump 8, is disposed substantially vertically with the two shafts mutually aligned. The lower shaft end 20 extends out of the motor 19 and carries a fan 21, a hub being fixed on the shaft end 20 against turning relative thereto. The motor 19 and the fan 21 are disposed within a largely cylindrical flow-channel 23 which is also disposed at the underside 18 of the hood 2, and can advantageously be formed in one piece with the hood 2. Furthermore, in the interior of the flow channel 23, stiffening ribs 24 are arranged which also serve to guide the air flow. The motor-driven fan 21 effects an air flow in direction of the arrows 25 and 26 and, as the air flows through the evaporation filter 5, it entrains the evaporated water. It should be pointed out that the housing may have a circular or an elongated rectangular cross-section in the plane perpendicular to the plane of the drawing. For this reason, in FIG. 1, the left-hand side is only partly shown. It is furthermore noted that all the electrical devices or components are arranged at the hood 2, including also the otherwise non-illustrated connection terminals, switches and the like. Assurance is thereby provided that when the hood 2 is lifted, all the electrical devices or components are separated from the remaining parts of the evaporation air-humidifier.

A releasable clutch 30 is located between the motor 19 and the pump 8. The clutch 30 has a first clutch-half 31, which is disposed at the lower shaft end 20. A second clutch-half 32 is associated with the clutch-half 31, and is connected to the shaft of the pump 8. The clutch-half 32 contains or is formed of a permanent magnet, whereas the first clutch-half 31 is formed of soft iron. The thus constructed magnetic clutch is so dimensioned that, in the illustrated state wherein the hood 2 is placed onto the container 1, a secure connection between the motor 19 and the pump 8 is formed, and therewith also a reliable drive of the pump 8 is assured. On the other hand, however, when the hood 2 is lifted, the existing connection is broken, and indeed without requiring any additional manipulations from the outside. Because, as mentioned hereinabove, all the electrical components are disposed in the hood 2, as mentioned hereinbefore, the water storage container 1, the pump 8, as well as the evaporation filter 5 can then be cleaned very easily. Only the hood 2 must be removed in order to separate the electrical devices including the motor 19 from the other parts of the evaporation air-humidifier.

In FIG. 2, the clutch 30 as well as the adjacent parts of the pump 8 and the fan 21 are shown in an enlarged view. As apparent in FIG. 2, the surfaces of the clutch-halves 31 and 32 facing towards one another, are substantially of conical construction, an additional cone 33 being provided, in the center, with a slope provided in the opposite direction. Due to the conical construction of the two clutch-halves 31 and 32, reliable guidance and centering is achieved when, respectively, setting the hood 2 in place and when mutually coupling the motor 19 and the pump 8. The mutually opposing surfaces of the clutch-halves 31 and 32 can be provided, if desired, with non-illustrated meshing teeth, to attain in all cases, for example also with a weak magnet, a reliable torque transfer. As shown in FIG. 2, the clutch half 32 is formed as a permanent magnet, and magnetized in direction of the arrow 34. The clutch half 31 can be formed of soft iron, but it may also be formed of a permanent magnet which, however, must be poled in the opposite direction. Furthermore, the clutch 30 is so dimensioned that the shaft 12 and the pump impeller 13, respectively, are lifted into the illustrated position thereof and, thereby, a special axial mounting or bearing for the pump 8 is not required.

To avoid the possibility that the shaft 12 drop too far from the illustrated, centered position thereof when the hood 2 is removed, the pump housing, and, more specifically, the support tube halves 9 and 10 are provided with radially inwardly directed projections 35 and 36. In the illustrated position thereof, a small gap is formed between the shaft 12 and the projections 35 and 36, and contact occurs therebetween.

As mentioned hereinbefore, the housing of the pump 8 is formed of the two support tube halves 9 and 10, and a lower pot-shaped housing part 11, which is connected by a detent connection with the support tube halves 9 and 10. To clean the pump 8, the housing part 11 is withdrawn downwardly, and the two support tube halves 9 and 10 can be swung away sidewardly. In this regard, it is important that, after the hood 2 has been lifted off, there be no connection any longer to the motor 19 and that the pump 8 be freely accessible.

Alternatively to the hereinaforedescribed magnetic clutch, other types of clutches may also be used. Other types, for example, are plug-in clutches. However, in all cases it is important that a trouble-free separation of the motor 19 and the pump 8 be effected without further manipulation when the hood 2 is lifted off, and when the hood 2 is repositioned onto the water storage container 1, the required connection between the motor 19 and the pump 8 is automatically established.

There is claimed:

1. Evaporation air-humidifier having a water storage container with a support plate carrying an evaporation filter and a pump extending into the water storage container, a fan, a motor for driving the pump, a hood formed with air inlet and air outlet openings, the motor being fastened to the hood, and a clutch between the motor and the pump, the clutch being automatically engageable when the hood is disposed on the storage container and automatically disengageable when the hood is removed from the storage container, comprising a substantially hollow cylindrical flow channel wherein the motor and the fan are disposed, said flow channel extending from the underside of the hood at least to the fan and including stiffening ribs located at the underside of the hood and within said flow channel, said flow channel and said stiffening ribs being formed in one piece with said hood, and said flow channel having a lower edge spaced from the support plate so as to define an annular space therebetween through which air may flow.

2. Evaporation air-humidifier according to claim 1 wherein said flow channel is surrounded by the evaporation filter at a minimum spacing maintained therefrom and including a liquid distributor channel disposed on the evaporation filter directly beneath the underside of the hood.

3. Evaporation air-humidifier according to claim 1 wherein the fan is located substantially halfway between the support plate and the underside of the hood.

4. Evaporation air-humidifier according to claim 1 wherein said flow channel extends from the underside of the hood to a location below the fan.

* * * * *